US006297777B1

(12) United States Patent
Tsubaki et al.

(10) Patent No.: US 6,297,777 B1
(45) Date of Patent: Oct. 2, 2001

(54) SURFACE-MOUNTED ANTENNA AND COMMUNICATION APPARATUS USING SAME

(75) Inventors: Nobuhito Tsubaki, Shiga-Ken; Shoji Nagumo, Kawasaki; Kazunari Kawahata, Machida, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/662,665

(22) Filed: Sep. 15, 2000

(30) Foreign Application Priority Data

Sep. 17, 1999 (JP) ..... 11-263809

(51) Int. Cl.[7] ..... H01Q 1/24; H01Q 1/38
(52) U.S. Cl. ..... 343/700 MS; 343/702
(58) Field of Search ..... 343/700 MS, 702, 343/873, 846; H01Q 1/38, 1/24

(56) References Cited

U.S. PATENT DOCUMENTS 5,917,450 * 6/1999 Tsunekawa et al. ..... 343/700 MS
6,002,369 * 12/1999 Richard ..... 343/700 MS
6,100,849 * 8/2000 Tsubaki et al. ..... 343/700 MS

* cited by examiner

*Primary Examiner*—Hoanganh Le
(74) *Attorney, Agent, or Firm*—Ostrolenk, Faber, Gerb & Soffen, LLP

(57) ABSTRACT

A compact surface-mounted antenna having a wide frequency band. In the surface-mounted antenna, a first radiation electrode is formed on the left-half region of the upper surface of a base dielectric substrate. A multi-layer dielectric substrate is laminated on the upper surface of the base dielectric substrate to be bonded and fixed thereto. A second radiation electrode is formed on the right-half region of the upper surface of the multi-layer dielectric substrate. The first and second radiation electrodes are not vertically opposed to each other. Opposing edges of the first and second radiation electrodes are oblique lines. A feeding signal of a signal source is supplied to the first radiation electrode by coupling from a feeding connection electrode, and then, is supplied to the second radiation electrode from the first radiation electrode by another coupling between the first and second radiation electrodes. A direction in which the first radiation electrode excites is set to be substantially perpendicular to a direction in which the second radiation electrode excites.

46 Claims, 7 Drawing Sheets

SURFACE-MOUNTED ANTENNA AND COMMUNICATION APPARATUS USING SAME

BACKGROUND OF THE INVENTION

1. Field of the Invention

The present invention relates to surface-mounted antennas and communication apparatus using the same, such as cellular phones.

2. Description of the Related Art

With the recent expanding proliferation of cellular phones, the technological development race is heating up with the aims of miniaturization and high performance of the cellular phones. In order to accomplish there aims, it is essential to reduce the sizes of antennas incorporated in the cellular phones while improving the performance of the antennas.

Although various antenna structures have been designed and provided, no antenna can sufficiently satisfy the demands for both high performance and miniaturization. This type of antenna is yet to appear on the market.

As a promising compact and highly efficient antenna the present inventors have focused much attention on a surface-mounted antenna. The surface-mounted antenna, for example, can be made by disposing a pair of electrodes close to each other on a surface of a dielectric base chip. In this case, the pair of electrodes is comprised of a radiation electrode of an inverted-F antenna and a radiation electrode of a microstrip antenna. In order to reduce the size of the surface-mounted antenna, the pair of radiation electrodes needs to be disposed on the surface of the dielectric base chip with a narrow gap therebetween.

However, when the pair of radiation electrodes is disposed with a narrow distance therebetween without considering the structure in which the electrodes are disposed, signal interference occurs between the radiation electrodes. This creates a critical problem in that it is difficult for the antenna to have a wide frequency bandwidth. In order to solve the problem, it is only necessary to greatly increase the gap between the pair of electrodes so that the signal interference between the pair of electrodes can be suppressed. However, increasing the gap between the radiation electrodes leads to an increase in the size of the base dielectric substrate, thereby necessarily increasing the size of the surface-mounted antenna. In other words, miniaturizing the antenna and obtaining a wide frequency band for the antenna are mutually contradictory objectives. When either one of these two objectives is achieved, the other one is difficult to achieve. Thus, with such a simple structure in which the pair of electrodes is disposed together, it is unlikely that the demands on miniaturization of the antenna and on obtaining of a wide frequency band for the antenna can be met.

However, by conducting much research and development, the present inventors have successfully designed an antenna having an innovative electrode-arrangement structure, which can meet both demands mentioned above.

SUMMARY OF THE INVENTION

Accordingly, in view of the above situation, based on the designed electrode-arrangement structure, it is an object of the present invention to provide a surface-mounted antenna whose size can be reduced while obtaining a wide frequency band, and a communication apparatus using the surface-mounted antenna.

To this end, the following arrangement is provided to solve the above problems. According to a first aspect of the present invention, there is provided a surface-mounted antenna including a base dielectric substrate, a first radiation electrode formed on a part of the upper surface of the base dielectric substrate, a multi-layer dielectric substrate laminated on the upper surface of the base dielectric substrate to be integrated therewith, and a second radiation electrode formed on the upper surface of the multi-layer dielectric substrate in a position where the second radiation electrode is not opposed to the first radiation electrode. In this surface-mounted antenna, directions in which the first radiation electrode and the second radiation electrode excite intersect with each other.

In addition, in this surface-mounted antenna, the upper surfaces of both the base dielectric substrate and the multi-layer dielectric substrate may have quadrangular shapes. The first radiation electrode may be formed on substantially half of the region of the upper surface of the base dielectric substrate. The second radiation electrode may be formed on substantially half of the region of the upper surface of the multi-layer dielectric substrate, which is opposed to the side where the first radiation electrode is formed. Edges of the first and second radiation electrodes present on sides mutually opposing via the multi-layer dielectric substrate may be oblique lines.

According to a second aspect of the present invention, there is provided a surface-mounted antenna including a base dielectric substrate, a first radiation electrode and a second radiation electrode on the upper surface of the base dielectric substrate via a gap, at least one multi-layer dielectric substrate laminated on the upper surface of the base dielectric substrate to be integrated therewith, and another first radiation electrode and another second radiation electrode formed on the upper surface of the multi-layer dielectric substrate via a gap. In this arrangement, directions in which the first radiation electrode and the second radiation electrode formed on each of the base dielectric substrate and at least one multi-layer dielectric substrate excite intersect with each other, and directions in which the vertically adjacent first and second radiation electrodes on the upper and lower layers excite differ from each other. For example, at least the directions in which the first radiation electrodes of the vertically adjacent layers excite differ from each other. Similarly, at least the directions in which the second radiation electrodes of the vertically adjacent layers excite also differ from each other.

In addition, in the surface-mounted antenna of the second aspect of the invention, the upper surfaces of both the base dielectric substrate and the multi-layer dielectric substrate may have both quadrangular shapes. The edges opposing via the gaps between the first radiation electrodes and the second radiation electrodes of the individual layers may be oblique lines.

According to a third aspect of the present invention, there is provided a surface-mounted antenna including a base dielectric substrate, a first radiation electrode formed on the upper surface of the base dielectric substrate, a multi-layer dielectric substrate laminated on the base dielectric substrate to be integrated therewith, and a second radiation electrode formed on the upper surface of the multi-layer dielectric substrate. In this arrangement, directions in which the first and second radiation electrodes excite intersect with each other.

Moreover, in the surface-mounted antenna according to one of the first to third aspects of the invention, the permittivity of the multi-layer dielectric substrate may be set to be higher than the permittivity of the base dielectric substrate.

Furthermore, in the surface-mounted antenna according to one of the second and third aspects of the invention, the permittivity of the multi-layer dielectric substrate laminated at the top may be set to be higher than the permittivity of the dielectric substrate of any other layer.

In addition, according to a fourth aspect of the present invention, there is provided a communication apparatus incorporating one of the surface-mounted antennas according to the first to third aspects of the invention.

In the surface-mounted antenna of the present invention, the first radiation electrode is formed on the partial region of the upper surface of the base dielectric substrate, and the second radiation electrode is formed in the position where the second radiation electrode is not opposed to the first radiation electrode on the upper surface of the multi-layer dielectric substrate laminated on the base dielectric substrate to be integrated therewith. The direction in which the first radiation electrode excites intersects with the direction in which the second radiation electrode excites. In this situation, the first radiation electrode is three-dimensionally opposed to the second radiation electrode in the vertically slanting direction via the multi-layer dielectric substrate. With this arrangement, even though the first and second radiation electrodes are set to be close to each other in a planar direction to narrow the gap between the radiation electrodes, the isolation effect between the radiation electrodes can be maintained high. Thus, since the signal interference between the radiation electrodes can be suppressed, the band of the communication wavelength can be widened, and moreover, the size of the antenna can be reduced.

In addition, in the surface-mounted antenna of the invention, at least one multi-layer dielectric substrate is integrally laminated on the upper surface of the base dielectric substrate, and the first radiation electrode and the second radiation electrode are formed on each of the upper surfaces of the base dielectric substrate and at least one multi-layer dielectric substrate via the gap. Similarly, the directions in which the first and second radiation electrodes formed on each layer excite intersect with each other. For example, the directions are substantially perpendicular to each other. As a result, signal interference occurring between the first and second radiation electrodes can be effectively suppressed. Therefore, owing to the effective suppression, the gap between the first and second radiation electrodes formed on each layer can be narrowed, and the size of the antenna can thereby be reduced. At the same time, due to the effect of suppressing the signal interference occurring between the radiation electrodes, the frequency band of communication wavelength can be widened.

BRIEF DESCRIPTION OF THE DRAWING(S)

DETAILED DESCRIPTION OF EMBODIMENTS OF THE INVENTION

Figure 1:
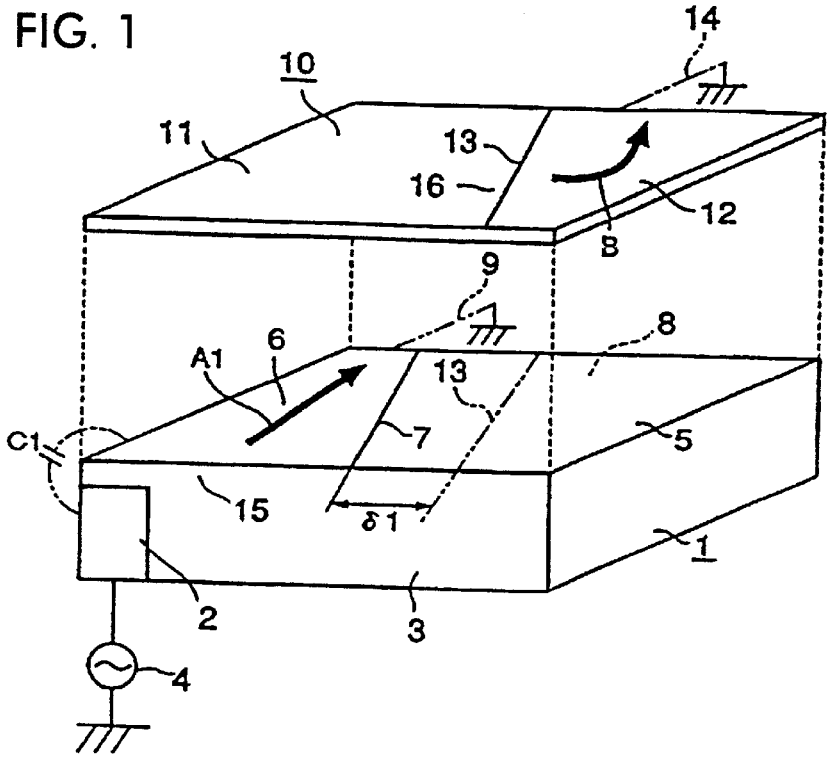
FIG. 1 is a structural view illustrating the main part of a surface-mounted antenna according to a first embodiment of the present invention.

A description will be given of embodiments of the present invention with reference to the drawings. In each of the embodiments below, the same reference numerals will be given to the same parts, and the explanation thereof will be omitted or simplified.

FIG. 1 shows the structure of the main part of a surface-mounted antenna according to a first embodiment of the present invention. In this figure, a base dielectric substrate 1 is formed of a material having a high permittivity such as ceramic or resin, and has a rectangular (rectangular parallelepiped) configuration. On the bottom of the base dielectric substrate 1, a grounding electrode (not shown) having a wide area and a feeding connection electrode 2 insulated from the grounding electrode are disposed. The feeding connection electrode 2 extends from the bottom of the base dielectric substrate 1 to the front surface 3 thereof. The feeding connection electrode 2 is connected to a signal source 4.

The upper surface of the base dielectric substrate 1 is denoted by reference numeral 5. A trapezoidal first radiation electrode 6 is formed of a conductive material in the left-half region of the upper surface 5 of the base dielectric substrate 1. An edge 7 of the trapezoidal electrode 6 comprises an oblique line. The first radiation electrode 6 is connected to the feeding connection electrode 2 by a capacitance C1. With this capacitive coupling, a feeding signal of the signal source 4 is provided to the first radiation electrode 6 via the feeding connection electrode 2 so that the first radiation electrode 6 resonates. The first radiation electrode 6 is connected to the grounding electrode of the bottom of the base dielectric substrate 1 via a conductive electrode (short circuit electrode) 9 disposed on the back surface (rear side surface) 8 thereof.

A multi-layer dielectric substrate 10 is laminated on the upper surface 5 of the base dielectric substrate 1. Both dielectric substrates 1 and 10 are made integrated by an adhesive or the like. The multi-layer dielectric substrate 10 is of thin laminations by using a material having a high permittivity such as ceramic or resin. A second radiation electrode 12 is formed in the right-half region of an upper surface 11 of the multi-layer dielectric substrate 10. The second radiation electrode 12 also has a trapezoidal shape. In this case, the front-and-back positional relationships of the top and bottom edges of the trapezoidal shape are reversed to those of the trapezoidal shape of the first radiation electrode 6. An edge 13 of the trapezoidal shape of the second radiation electrode 12 comprises an oblique line. The edge 13 is opposed to the oblique edge 7 of the first radiation electrode 6 via the multi-layer dielectric substrate 10 with a three-dimensional gap in an upper slanting direction. The gap between the radiation electrodes in the planar direction is set to be 81.

The second radiation electrode 12 is connected to the grounding electrode on the bottom of the base dielectric substrate 1 via a conducting electrode (short circuit electrode) 14 formed on side surfaces at the back (rear side) of the multi-layer dielectric substrate 10 and the base dielectric substrate 1. Since the bottom of the base dielectric substrate 1 is mounted on a grounding surface of a mounting substrate (not shown), the conducting electrode 9 of the first radiation electrode 6 and the conducting electrode 14 of the second radiation electrode 12 are both connected to the grounding surface of the mounting substrate.

Now, a description will be given of the operation of the surface-mounted antenna of the first embodiment. When a feeding signal is output from the signal source 4, the feeding signal is supplied to the first radiation electrode 6 by a capacitive coupling with the feeding connection electrode 2, while the feeding signal is also supplied to the second radiation electrode 12 by a capacitive coupling between the first radiation electrode 6 and the second radiation electrode 12.

The current of the signal supplied to the first radiation electrode 6 flows from the conducting electrode 9 to an open end 15 of a high electric-field part. For example, the first radiation electrode 6 resonates at a frequency $f_1-\Delta f$ close to the low frequency side of a set frequency $f_1$ to excite in the direction of an arrow A, which is the same direction as that of the vector of the current flow. Meanwhile, the current of a signal supplied to the second radiation electrode 12 flows from the conducting electrode 14 to an open end 16 of the high electric-field part. The second radiation electrode 12 resonates at a frequency $f_1+\Delta f$ close to the high frequency side of the set frequency $f_1$ to excite in the direction of an arrow B, which is the same direction as that of the vector of the current flow. In other words, the direction in which the first radiation electrode 6 excites, which is the polarizing direction thereof, is set to be substantially perpendicular to the direction in which the second radiation electrode 12 excites, which is the polarizing direction thereof.

Figure 3A:
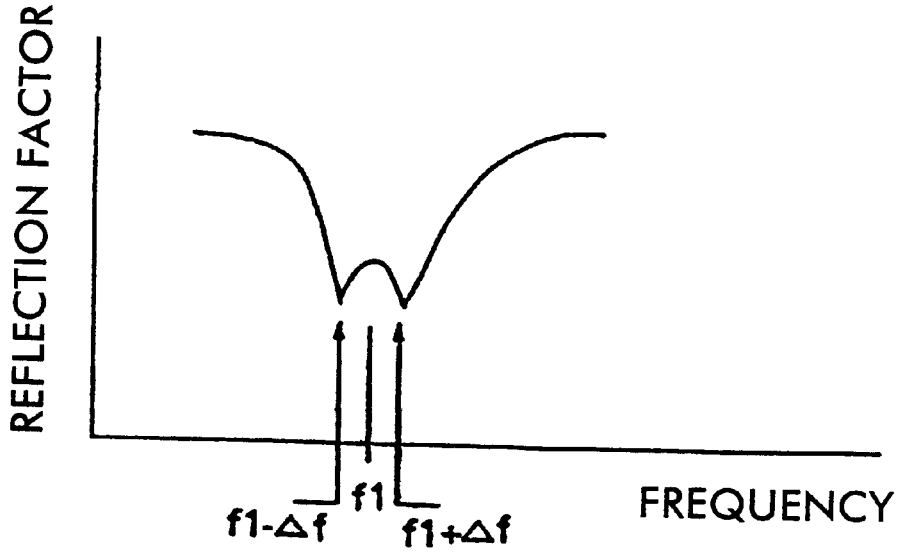
FIGS. 3A and 3B show illustrations of operational examples of a double resonance applied to each of the first and second embodiments.
Figure 3B:
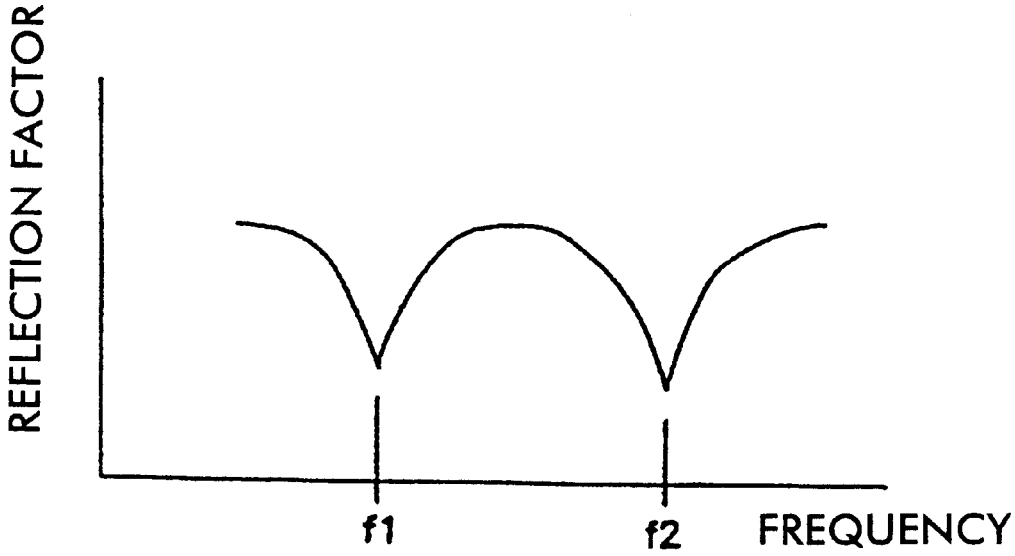

With the double resonance produced by the first radiation electrode 6 and the second radiation electrode 12, as shown in FIG. 3A, the frequency band of the set frequency $f_1$ used as a communication frequency can be widened. It is possible to perform communications at the two frequencies $f_1$ and $f_2$ by separating the set frequency $f_1$ of the first radiation electrode 6 and the set frequency $f_2$ of the second radiation electrode 12 from each other.

In the above embodiment, when the multi-layer dielectric substrate 10 is laminated on the base dielectric substrate 1 to be integrated therewith, the first radiation electrode 6 and the second radiation electrode 12 are not opposed to each other. Furthermore, the arrangement is set such that the direction A in which the first radiation electrode 6 excites is substantially perpendicular to the direction B in which the second radiation electrode 12 excites. In addition, the edge 7 of the first radiation electrode 6 and the edge 13 of the second radiation electrode 12 are three-dimensionally opposed to each other in a vertically slanting direction via the multi-layer dielectric substrate 10. As a result, isolation between the resonant signal of the first radiation electrode 6 and the resonant signal of the second radiation electrode 12, that is, suppression of signal interference, can be enhanced although the gap δ1 between the electrodes is narrowed in the horizontal direction (planar direction). Therefore, with this arrangement, the band of the set frequency can be widened while reducing the size of the antenna.

In addition, in this embodiment, since the first radiation electrode 6 and the second radiation electrode 12 are independently formed on the dielectric substrates 1 and 10 forming the multi-layer structure, by selectively varying the permittivity of each of the dielectric substrates 1 and 10, an advantage in improving antenna characteristics can be obtained. For example, by changing the permittivity of the multi-layer dielectric substrate 10 as needed, the isolation characteristics of the resonant signal of the first radiation electrode 6 and the resonant signal of the second radiation electrode 12 can be suppressed. In other words, when the permittivity of the multi-layer dielectric substrate 10 is reduced, an electric-field strength between the first and second radiation electrodes 6 and 12 decreases, and isolation thereby increases. In contrast, when the permittivity of the multi-layer dielectric substrate 10 is increased, the isolation decreases, although high permittivity is desirable in order to minimize the dielectric substrate. Therefore, by selectively adjusting the permittivity of the multi-layer dielectric substrate 10, it is possible to freely control the isolation characteristics between the radiation electrodes 6 and 12.

In addition, when the surface-mounted antenna is on the grounding surface of the mounting substrate, a capacitance (mounting-substrate capacitance) occurs between the grounding surface of the mounting substrate and the radiation electrodes 6 and 12, and the electric-fields of the radiation electrodes concentrate on the capacitance, with the result that the band of the used frequency of the antenna tends to be narrowed. However, in this embodiment, since a multi-layer structure constituted by laminating the dielectric substrates 1 and 10 is provided, when the permittivity of the upper multi-layer dielectric substrate 10 is set to be higher (greater) than the permittivity of the lower base dielectric substrate 1, the electric fields can be concentrated on the upper multi-layer dielectric substrate 10. As a result, the electric-field concentration on the mounting-substrate capacitance can be alleviated, thereby leading to obtaining an advantage in that the band of the used frequency can be widened.

When the antenna is miniaturized, areas occupied by the radiation electrodes 6 and 12 are necessarily reduced, and the antenna gain thereby decreases. However, as shown above, in this embodiment, the gap δ1 between the radiation electrodes 6 and 12 can be narrowed. Owing to this advantage, the areas occupied by the radiation electrodes 6 and 12 can be increased. Therefore, the decrease in the antenna gain caused by miniaturizing the antenna can be suppressed. As a result, the arrangement of the present embodiment can provide a compact surface-mounted antenna having high performance, which can meet the demands for maintaining gain and widening the bandwidth.

Figure 2:
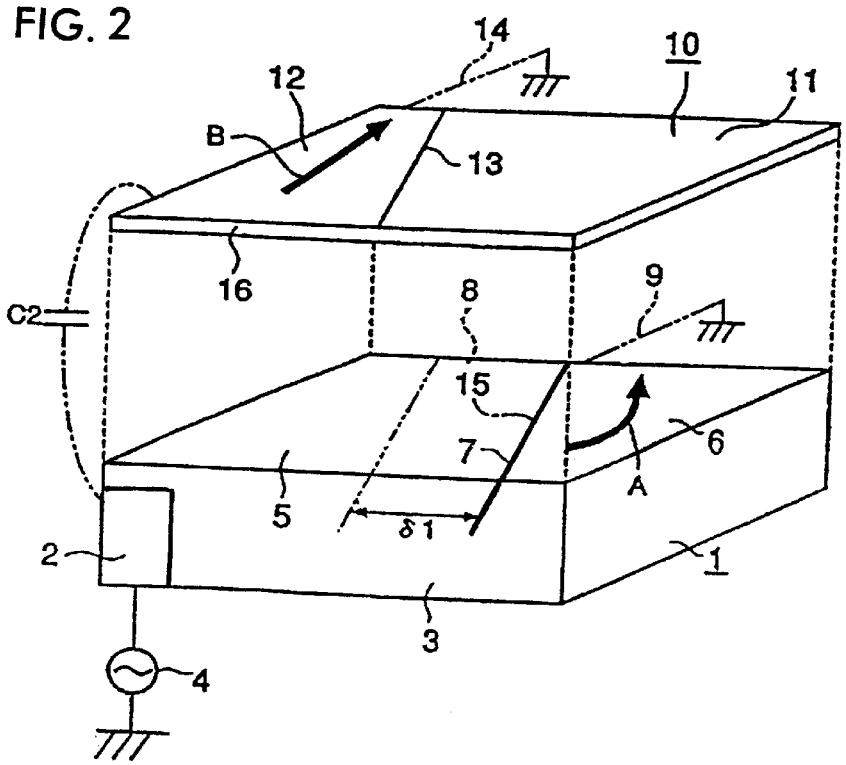
FIG. 2 is a structural view illustrating the main part of a surface-mounted antenna according to a second embodiment of the present invention.

FIG. 2 shows the structure of the main part of the surface-mounted antenna according to a second embodiment of the present invention. Unlike the first embodiment, in this embodiment, positions at which radiation electrodes 6 and 12 are disposed are reversed left to right, and the orientations of the trapezoidal radiation electrodes 6 and 12 are also reversed to each other. In this arrangement, since a feeding connection electrode 2 and the second radiation electrode 12 are coupled by a capacitance C2, the feeding signal from a signal source 4 is capacitively fed to the second radiation electrode 12 via the capacitance C2. Additionally, since the first radiation electrode 6 is capacitively coupled with the second radiation electrode 12, the signal from the signal source 4 is fed to the first radiation electrode 6 via the second radiation electrode 12.

Similar to the first embodiment, in the second embodiment, an edge 7 of the first radiation electrode 6 and an edge 13 of the second radiation electrode 13 are opposed to each other with a gap in a vertically slanting direction via the multi-layer dielectric substrate 10. In addition, a direction A in which the first radiation electrode 6 excites is substantially perpendicular to a direction B in which the second radiation electrode 12 excites. As a result, the radiation electrodes of the second embodiment act in the same way as those of the first embodiment, and the same advantages as those obtained in the first embodiment can be obtained.

Figure 4:
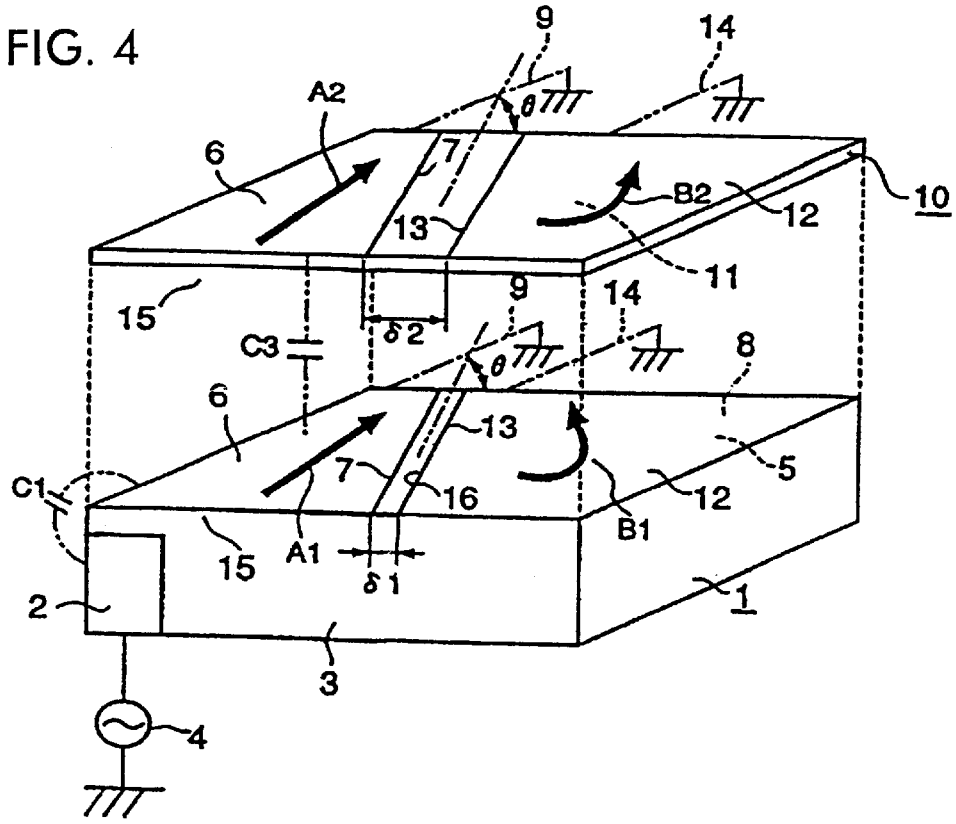
FIG. 4 is a structural view illustrating the main part of a surface-mounted antenna according to a third embodiment of the present invention.

FIG. 4 shows the structure of the main part of a surface-mounted antenna according to a third embodiment of the present invention. Similar to the other embodiments, in this embodiment, a multi-layer dielectric substrate 10 is laminated on an upper surface 5 of a base dielectric substrate 1 to be integrated therewith. Unlike the first and second embodiments, in the third embodiment, on each of the upper surface 5 of the base dielectric substrate 1 and an upper surface 11 of the multi-layer dielectric substrate 10, a pair comprising a first radiation electrode 6 and a second radiation electrode 12 is formed via individually corresponding gaps δ1 and δ2. On the left-side region of the upper surface 5 of the base dielectric substrate 1, the first radiation electrode 6 having a trapezoidal shape is formed, and on the right-side region thereof the second radiation electrode 12 similarly having a trapezoidal shape is formed. The first radiation electrode 6 and the second radiation electrode 12 are opposed to each other via the gap δ1, and mutually opposing edges 17 and 13 of the first and second radiation electrode 6 and 12 are oblique lines.

The first radiation electrode 6 capacitively couples with a feeding connection electrode 2 by a capacitance C1, and the second radiation electrode 12 capacitively couples with the first radiation electrode 6 via the capacitance of the gap δ1. The degree of isolation between a signal (resonant signal) of the first radiation electrode 6 and a signal (resonant signal) of the second radiation electrode 12 is set by the length (width) of the gap δ1. As the length of the gap δ1 is increased, the isolation becomes greater.

Similarly, on the left side of the upper surface 11 of the multi-layer dielectric substrate 10, another first radiation electrode 6 having a trapezoidal shape is formed. On the right side thereof another second radiation electrode 12 having a trapezoidal shape is formed. Mutually opposing edges 7 and 13 of the first and second radiation electrodes 6 and 12 via the gap δ2 are oblique lines. The degree of isolation between the pair of the first radiation electrode 6 and the second radiation electrode 12 is also set by the length of the gap δ2. The first radiation electrode 6 of the multi-layer dielectric substrate 10 couples with the first radiation electrode 6 of the base dielectric substrate 1 by a capacitance C3, and the first radiation electrode 6 and the second radiation electrode 12 of the multi-layer dielectric substrate 10 capacitively couples with each other by the capacitance of the gap δ2.

In FIG. 4, although the short circuit edges of the first and second radiation electrodes 6 and 12 are connected to the grounding surface via conducting electrodes 9 and 14, it is also possible to eliminate the conducting electrodes 9 and 14 so as to make a structure in which the short edges of the first and second radiation electrodes 6 and 12 are isolated from the grounding surface.

In the third embodiment, a feeding signal supplied from a signal source 4 is supplied to the first radiation electrode 6 of the base dielectric substrate 1 via the capacitance C1, and then is supplied to the second radiation electrode 12 of the base dielectric substrate 1 via the capacitance of the gap δ1. Meanwhile, the feeding signal from the first radiation electrode 6 of the base dielectric substrate 1 is supplied to the first radiation electrodes 6 of the multi-layer dielectric substrate 10 via the capacitance C3, and then, is supplied from the first radiation electrode 6 of the multi-layer dielectric substrate 10 to the second radiation electrode 12 thereof via the capacitance of the gap δ2.

In each of the first and second radiation electrodes 6 and 12 of the base dielectric substrate 1 and the multi-layer dielectric substrate 10, a current flows from the short edges (conducting electrodes 9 and 14) to open ends 15 and 13. Then, the first radiation electrode 6 of the base dielectric substrate 1 excites in a direction A1 which is the same direction as that of the vector of the current flow, and the second radiation electrode 12 similarly excites in a direction B1, which is substantially perpendicular to the direction A1. Similarly, the first radiation electrode 6 of the multi-layer dielectric substrate 10 excites in a direction A2, and the second radiation electrode 12 excites in a direction B2, which is substantially perpendicular to the direction A2.

Figure 8A:
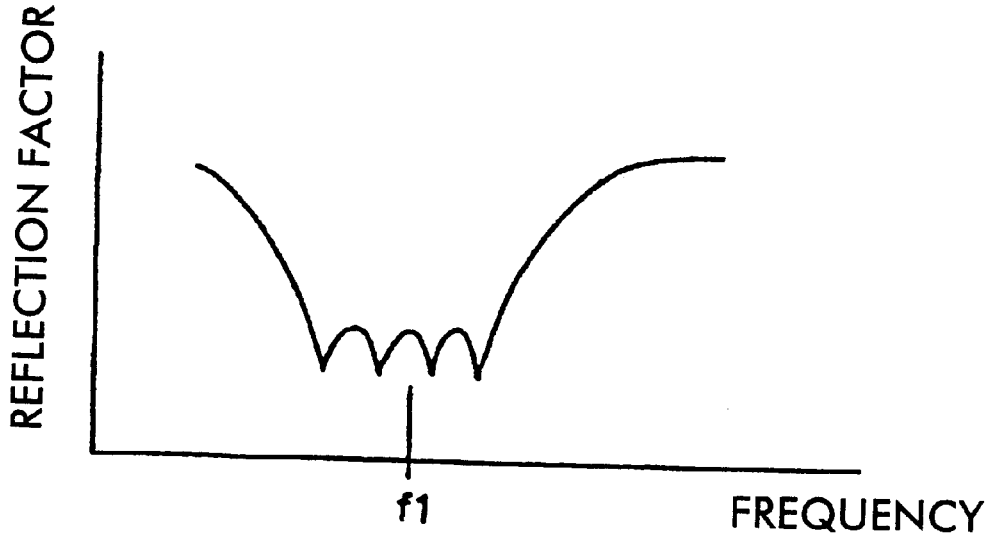
FIGS. 8A and 8B show illustrations of operational examples of a double resonance applied to each of the third to seventh embodiments.

In this case, since the radiation electrodes 6 and 12 of the base dielectric substrate 1 and those of the multi-layer dielectric substrate 10 individually resonate, four resonant operations in total are performed. Therefore, for example, by setting the resonant frequencies of the individual radiation electrodes to be near both sides of a set frequency $f_1$, as shown in FIG. 8A, with the result of resonant operations of the four radiation electrodes, the band of the set frequency $f_1$ can be widened.

Figure 8B:
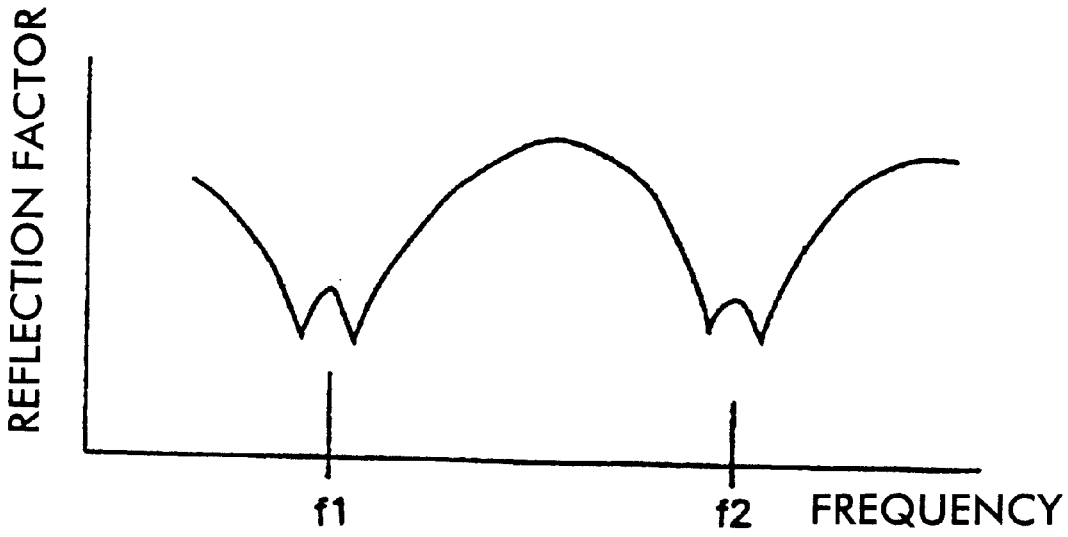

In addition, for example, when the resonant frequencies of the radiation electrodes 6 and 12 of the base dielectric substrate 1 are set to be near the set frequency $f_1$ and the resonant frequencies of the radiation electrodes 6 and 12 of the multi-layer dielectric substrate 10 are set to be near a set frequency $f_2$, as the result of the double resonance of the radiation electrodes 6 and 12 of the base dielectric substrate 1 and the double resonance of the radiation electrodes 6 and 12 of the multi-layer dielectric substrate 10, as shown in FIG. 8B, the bands of the set frequencies $f_1$ and $f_2$ can be widened.

In the third embodiment, the directions in which the first radiation electrode 6 and the second radiation electrode 12 of a first layer formed on the upper surface 5 of the base dielectric substrate 1 excite are substantially perpendicular to each other. In addition, the directions in which the first radiation electrode 6 and the second radiation electrode 12 of a second layer formed on the upper surface 11 of the multi-layer dielectric substrate 10 excite are also substantially perpendicular to each other. As a result, even though the gaps δ1 and δ2 are narrowed, interference between the resonant signals of the first and second radiation electrodes 6 and 12 of each layer can be suppressed, that is, isolation can be enhanced. Thus, a wide frequency band for the antenna can be obtained.

Furthermore, since the gaps δ1 and δ2 can be narrowed, the antenna can be miniaturized. Additionally, by narrowing the gaps δ1 and δ2, since the areas for disposing the first and second radiation electrodes can be increased, it is possible to increase the gain of the antenna.

When the two-layer structure composed of the first radiation electrodes 6 and the second radiation electrodes 12 is provided as described above, it is necessary to obtain isolation between the resonant signals of the first radiation electrodes 6 mutually opposing in the vertical direction and, similarly, isolation between the resonant signals of the second radiation electrodes 12 mutually opposing in the vertical directions. In this case, in the third embodiment, the first radiation electrodes 6 and the second radiation electrodes 12 of the individual layers are disposed via each of the gaps δ1 and δ2, and edges 7 of the first radiation electrodes 6 and edges 13 of the second radiation electrodes 12 are opposed to each other via each of the gaps δ1 and δ2. The edges 7 and 13 of the first and second radiation electrodes 6 and 12 opposing via each of the gaps δ1 and δ2 are oblique lines. As a result, by varying the lengths and angles θ of the gaps δ1 and δ2, the isolation between the first and second radiation electrodes 6 and 12 of the upper and lower layers can be easily adjusted.

In other words, when the direction A1 in which the first radiation electrode 6 of the base dielectric substrate 1 excites is parallel to the direction A2 in which the first radiation electrode 6 of the multi-layer dielectric substrate 10 thereabove excites, the interference of resonant signals is likely to occur between the first radiation electrodes 6 of the upper and lower layers. Similarly, when the direction B1 in which the second radiation electrode 12 of the base dielectric substrate 1 excites is parallel to the direction B2 in which the second radiation electrode 12 of the multi-layer dielectric substrate 10 thereabove excites, the interference of resonant signals is likely to occur between the second radiation electrodes 12 of the upper and lower layers.

In this case, it is only necessary to change at least one of the gaps δ1 and δ2 between the radiation electrodes 6 and 12. With this change, the direction of a current flowing through each of the radiation electrodes 6 and 12 of the layer having the changed gap slightly changes. According to the changes in the direction in which the current flows, since the exciting direction also slightly changes, the exciting directions of the radiation electrodes 6 and 12 of the upper and lower layers result in adjustment in different directions, specifically, in non-parallel directions, thereby leading to the prevention of signal interference.

Similarly, when the angles of the gaps between the radiation electrodes 6 and 12 of the upper and lower layers are changed, the direction of a current flowing through each of the radiation electrodes 6 and 12 of the layer having the changed gap angle slightly changes. According to the changes in the direction in which the current flows, since the exciting direction also slightly changes, the exciting directions of the electrodes of the upper and lower layers result in being adjusted in different directions, specifically, in non-parallel directions. Thus, signal interference can be prevented.

Near the place where the gap angle θ is 90 degrees, the direction of a current flowing through the radiation electrode 6 is parallel to the direction of a current flowing through the radiation electrode 12. Corresponding to the directions in which the currents flow, the direction in which the radiation electrode 6 excites becomes parallel to the direction in which the radiation electrode 12 excites. As a result, signal interference is likely to occur between the radiation electrode 6 and the radiation electrode 12. Therefore, when each of the gap angles is adjusted, in order to avoid signal interference occurring between the radiation electrode 6 and the radiation electrode 12 of the same layer, it is necessary to make the adjustment in an angular range excluding angles near 90 degrees.

As describe above, when the directions in which the radiation electrodes 6 and 12 of the upper and lower layers excite are parallel to each other, by adjusting either the gap lengths between the radiation electrodes 6 and 12 or the gap angles, or both of the gap lengths and angles, isolation effects of signals between the radiation electrodes of the upper and lower layers can be increased to suppress the interference of the signals therebetween so as to achieve widening of the frequency band.

Moreover, as described in the first and second embodiments, the degree of the isolation of the signals between the radiation electrodes of the upper and lower layers can be adjusted by selectively changing the permittivity of the multi-layer dielectric substrate 10. Therefore, by making the combination adjustment of the gap between the radiation electrodes 6 and 12, the gap angle, and the permittivity, prevention of the interference of the signals between the radiation electrodes of the upper and lower layers can be greatly facilitated.

Moreover, as in the case of each of the above first and second embodiments, similarly, in the third embodiment, by setting the permittivity of the upper multi-layer dielectric substrate 10 to be higher than the permittivity of the base dielectric substrate 1, the concentration of electric-fields on a fringing capacitance between the mounting substrate and the radiation electrodes can be suppressed to concentrate the electric fields on the upper multi-layer dielectric substrate 10 so as to achieve widening of the frequency band.

Figure 5:
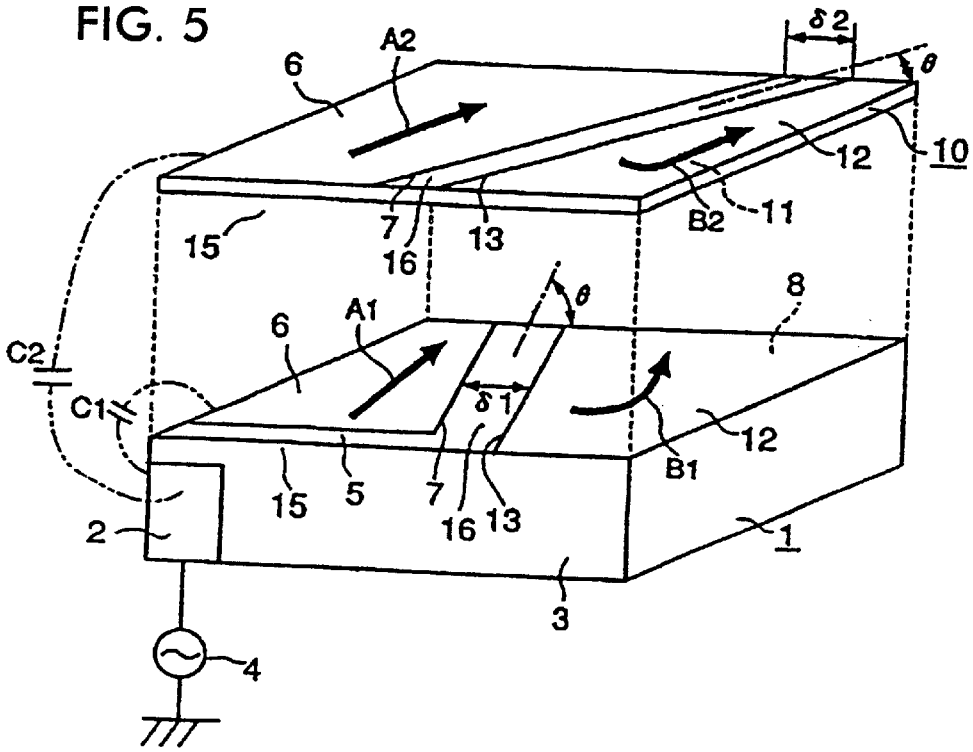
FIG. 5 is a structural view illustrating the main part of a surface-mounted antenna according to a fourth embodiment of the present invention.

FIG. 5 shows the structure of the main part of a surface-mounted antenna according to a fourth embodiment of the present invention. Unlike the third embodiment, in the antenna of the fourth embodiment, the lower end of a radiation electrode 5 is not extended to the front side surface 3 of the base dielectric substrate 1 but a gap is provided. The feeding connection electrode 2 is coupled with the first radiation electrode 6 of the multi-layer dielectric substrate 10 by a capacitance C2 and with radiation electrode 6 of base substrate 1 by capacitance C1. The other structural parts are formed in the same manner as those in the third embodiment. The antenna of the fourth embodiment operates in the same way as that of the third embodiment to obtain the same advantages as those of the third embodiment. Although the lengths of the gap δ1 and δ2 between the radiation electrodes 6 and 12 and the gap angles θ shown in FIG. 5 are different from those shown in FIG. 4, this conceptually shows that interference of the signals between the radiation electrodes 6 and 12 of the upper and lower layers can be prevented by adjusting isolation according to the varied lengths of the gap δ1 and δ2 and the gap angles θ.

Figure 6:
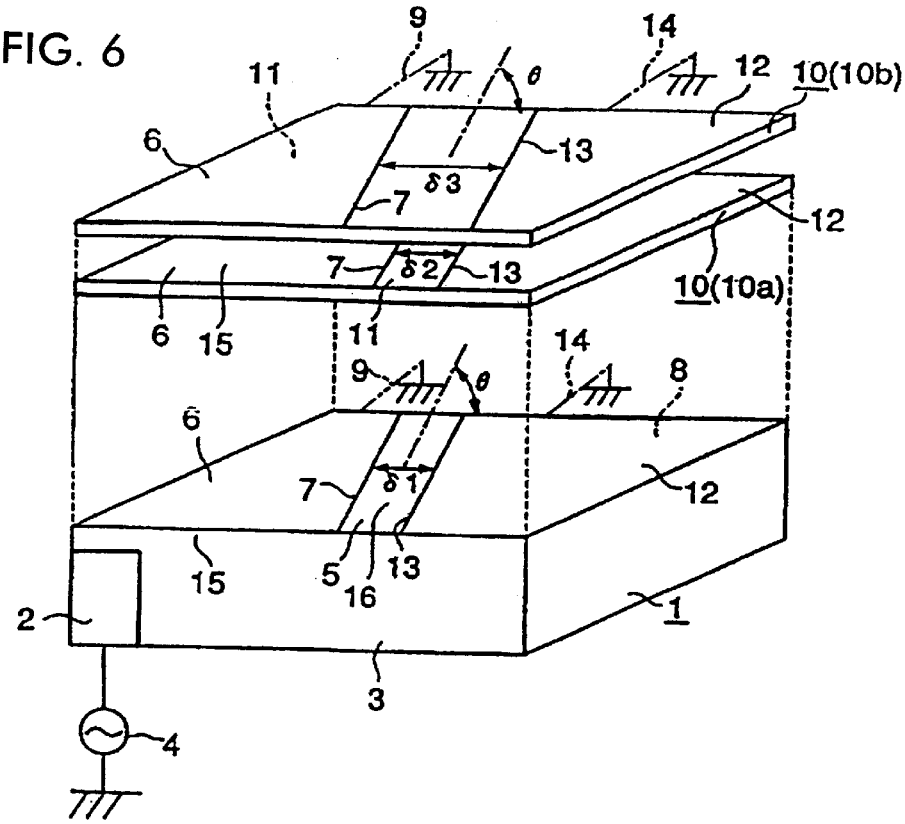
FIG. 6 is a structural view illustrating the main part of a surface-mounted antenna according to a fifth embodiment of the present invention.

FIG. 6 shows the structure of the main part of a surface-mounted antenna according to a fifth embodiment of the present invention. In the fifth embodiment, two multi-layer dielectric substrates 10, that is, 10*a* and 10*b*, are laminated on an upper surface 5 of a base dielectric substrate 1 having the radiation electrodes 6 and 12 of a first layer formed thereon to be integrated with the base dielectric substrate 1. The other structural parts are formed in the same manner as those shown in the third embodiment. On an upper surface 11 of the multi-layer dielectric substrate 10*a*, radiation electrodes 6 and 12 of a second layer are formed via a gap δ2. On an upper surface 11 of the multi-layer dielectric substrate 10*b*, radiation electrodes 6 and 12 of a third layer are formed via a gap δ3.

A feeding connection electrode 2 and the first radiation electrode 6 of the base dielectric substrate 1 are capacitively coupled with each other. The first radiation electrode 6 of the base dielectric substrate 1 and the first radiation electrode 6 of the multi-layer dielectric substrate 10*a* are capacitively coupled with each other. In addition, the first radiation electrode 6 of the multi-layer dielectric substrate 10*a* and the first radiation electrode 6 of the multi-layer dielectric substrate 10*b* are also capacitively coupled with each other. The first and second radiation electrodes 6 and 12 of the individual layers are coupled with each other via the capacitance of each of the corresponding gaps δ1, δ2, and δ3. As a result, a feeding signal from a signal source 4 is supplied to all of the radiation electrodes 6 and 12 via each coupling capacitance, and then, a double resonance is obtained between the radiation electrodes 6 and 12 of each layer to obtain six multiple resonances in total.

Similar to the other embodiments, in the fifth embodiment, by adjusting the gaps δ1, δ2, and δ3 between the radiation electrodes of the individual layers and the gaps angles θ as needed, directions in which the radiation electrodes of the individual layers vertically adjacent excite can be adjusted in different directions, that is, in non-parallel directions. In addition, by selectively changing the permittivity of each of the multi-layer dielectric substrates 10*a* and 10*b*, isolation between the vertically adjacent upper and lower layers can be adjusted.

Furthermore, in this embodiment, by setting the permittivity of each of the multi-layer dielectric substrates 10*a* and 10*b* to be higher than the permittivity of the base dielectric substrate 1, electric fields are concentrated on the multi-layer dielectric substrates 10*a* and 10*b* so that the band of a set frequency can be widened. Particularly, by maximizing the permittivity of the top multi-layer dielectric substrate 10 (10*b*), the electric fields can be concentrated on the top multi-layer dielectric substrate 10 (10*b*). As a result, the band of the set frequency can be more effectively widened. Besides this, the same other advantages as those obtained in the other embodiments can be obtained in the fifth embodiment.

In the fifth embodiment, although the two multi-layer dielectric substrates 10 are laminated on the base dielectric substrate 1, it is also possible to produce many more resonances by laminating and integrating three or more multi-layer dielectric substrates 10 having radiation electrodes 6 and 12 on the upper surface thereof.

Figure 7:
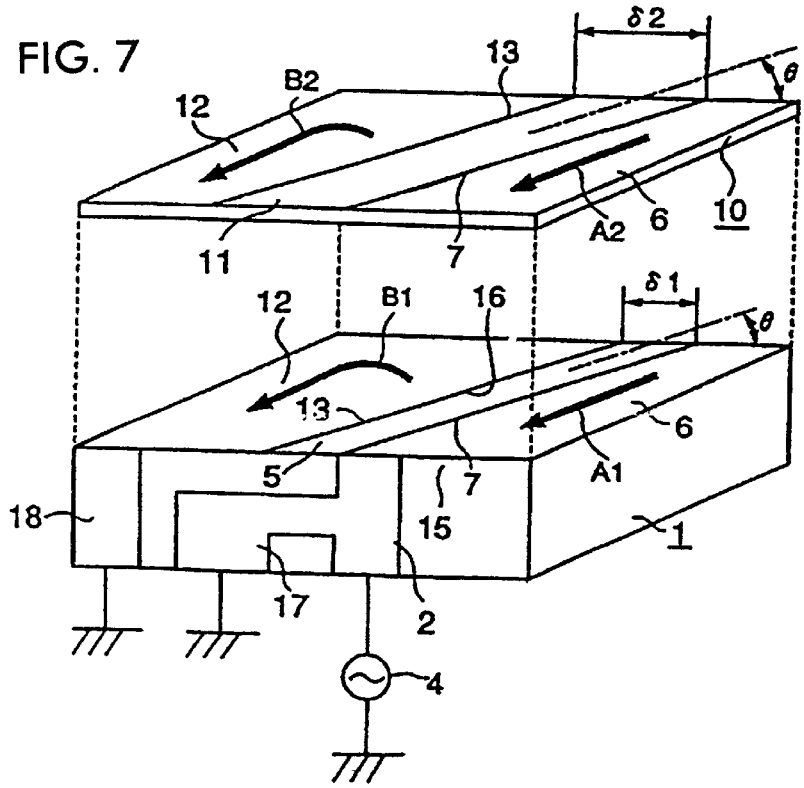
FIG. 7 is a structural view illustrating the main part of a surface-mounted antenna according to a sixth embodiment of the present invention.

FIG. 7 shows the structure of the main part of a surface-mounted antenna according to a sixth embodiment of the present invention. In each of the first to fifth embodiments, the provided antenna is a capacitance feeding type of antenna. However, such a capacitance feeding type of antenna can be easily converted into a direct excitation type of antenna only by changing the feeding circuit, that is, by changing the capacitance feeding circuit into a direct excitation circuit. The sixth embodiment shows a typical structure in which the capacitance feeding type of antenna shown in FIG. 4 is converted into the direct excitation type of antenna.

In the sixth embodiment, a feeding connection electrode 2, which is electrically connected to a first radiation electrode 6, is disposed on a side surface of a base dielectric substrate 1. A short circuit electrode 17 is formed by branching from a certain point of the feeding connection electrode 2. Then, a short circuit electrode 18 conductively coupled to a second radiation electrode 12 is formed near the short circuit electrode 17 to form the direct excitation circuit. The first radiation electrode 6 of the base dielectric substrate 1 and the first radiation electrode 6 of the multi-layer dielectric substrate 10 are capacitively coupled with each other. The first radiation electrode 6 and the second radiation electrode 12 of the multi-layer dielectric substrate 10 are coupled with each other by the capacitance of a gap δ2.

In the circuit shown in FIG. 7, while a feeding signal from a signal source 4 is directly supplied to the first radiation electrode 6 of the base dielectric substrate 1 via the feeding connection electrode 2, with the magnetic-field coupling between the short circit electrodes 17 and 18, the feeding signal is supplied to the second radiation electrode 12 of the base dielectric substrate 1 via the short circuit electrode 18. The feeding signal supplied to the first radiation electrode 6 of the base dielectric substrate 1 is supplied to the first radiation electrode 6 of the multi-layer dielectric substrate 10 via a capacitive coupling, and then is supplied to the second radiation electrode 12 of the multi-layer dielectric substrate 10 via the capacitive coupling of the gap δ2. With this arrangement, since the radiation electrodes 6 and 12 of each layer perform resonant operations as in the case of the third embodiment, the same advantages as those obtained in the third embodiment can be obtained in the sixth embodiment.

Figure 9:
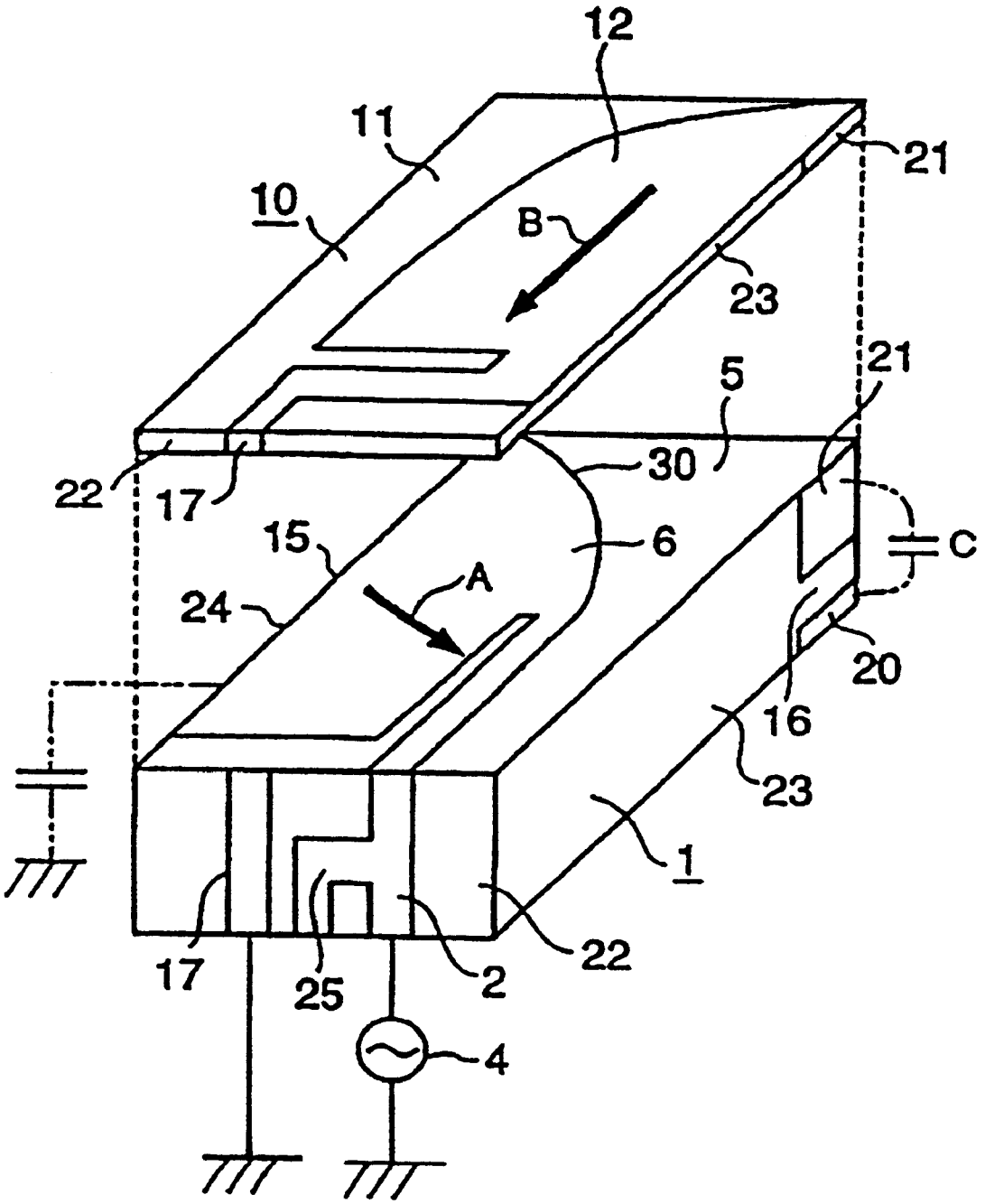
FIG. 9 is a structural view illustrating the main part of a surface-mounted antenna according to a seventh embodiment of the present invention.

FIG. 9 shows the structure of the main part of a surface-mounted antenna according to a seventh embodiment of the present invention. In the seventh embodiment, a first radiation electrode 6 is formed on an upper surface 5 of a base dielectric substrate 1. On the upper surface 5 of the base dielectric substrate 1, a multi-layer dielectric substrate 10 is laminated to be integrated therewith. Then, on an upper surface 11 of the multi-layer dielectric substrate 10, a second radiation electrode 12 is formed. The first radiation electrode 6 is widened to side surfaces 23 and 24 of the base dielectric substrate 1. The width of the first radiation electrode 6 is substantially even in the region of a side surface 22, which is the region of a frontend side surface. On the rear end of the base dielectric substrate 1, which is the back side thereof the peripheral edge of the side surface 23 of the radiation electrode 6 forms a bending surface 30 by retreating to the side surface 24. The width of the radiation electrode pattern tapers down like a fan-like shape from the front-end side surface 22 to the rear-end side, which is the back surface side of the base dielectric substrate 1.

A feeding connection electrode 2 and a short circuit electrode 17 are vertically formed on the side surface 22 (front surface) of the base dielectric substrate 1. A short circuit electrode 25 is formed by branching from an intermediate point of the feeding connection electrode 2. The short circuit electrode 25 branched from the feeding connection electrode 2 in a horizontal direction is perpendicularly bent in a lower direction to form a parallel pattern close to the short circuit electrode 17. The lower end of the short circuit electrode 25 is conducted to a grounding electrode 20 on the bottom of the base dielectric substrate 1. The upper end of the feeding connection electrode 2 is connected to the first radiation electrode 6 of the upper surface 5 of the base dielectric substrate 1, and the lower end thereof is connected to a signal source 4. The first radiation electrode 6 is capacitively coupled with the grounding electrode formed on the bottom of the base dielectric substrate 1 at the side surface (left side surface) 24. As a result, the side surface 24 is an open end 15.

Near the rear end of the side surface (right side surface) 23 of the base dielectric substrate 1, an electrode 21 is formed from the upper end to the intermediate part of the side surface 23. The lower end face of the electrode 21 is capacitively coupled with the upper end face of the grounding electrode 20 extended from the bottom of the base dielectric substrate 1 via a gap by a capacitance C.

The second radiation electrode 12 formed on an upper surface 11 of the multi-layer dielectric substrate 10 makes a pattern whose right and left positions are substantially reversed to those of the pattern of the first radiation electrode 6 excepting a connecting electrode pattern. That is, the pattern of the second radiation electrode 12 is substantially 180-degrees reversed thereto. The second radiation electrode 12 is connected to the short circuit electrode 17 of the base dielectric substrate 1 by a short circuit electrode 17 disposed on the side surface (front surface) 22 of the same side as that of the base dielectric substrate 1.

Another electrode 21 electrically connected to the second radiation electrode 12 is disposed close to the rear end of the side surface (right side surface) 23 of the multi-layer dielectric substrate 10. The electrode 21 on the multi-layer dielectric substrate 10 is electrically connected to the upper end of the electrode 21 disposed on the side surface 23 of the base dielectric substrate 1. As a result, the second radiation electrode 12 couples with the grounding electrode by a capacitance C via the electrode 21. The capacitive coupling part is an open end 16 of the second radiation electrode 12.

In the seventh embodiment, a feeding signal supplied from the signal source 4 is supplied to the first radiation electrode 6 from a feeding connection electrode 2. A current flows to the open end 15 from the short circuit in the first radiation electrode 6, which is excited. In this case, the vector direction of the current flow is equivalent to a direction A in which the first radiation electrode 6 excites.

The feeding signal supplied from the signal source 4 is also provided to the second radiation electrode 12 via the magnetic-field coupling between the short circuit electrode 25 and the short circuit electrode 17. A current flows from the short circuit to the open end 23 in the second radiation electrode 12. The vector direction of the current flow is equivalent to a direction B in which the second radiation electrode 6 excites. In this direction, the second radiation electrode 12 is excited.

Similar to the other embodiments, in the seventh embodiment, since the direction (direction A) in which the first radiation electrode 6 excites is set to be substantially perpendicular to the direction (direction B) in which the second radiation electrode 12 excites, interference of resonant signals between the radiation electrodes 6 and 12 can be suppressed, thereby leading to widening of the frequency band. Furthermore, as described in each of the embodiments, by selectively adjusting the permittivity of the multi-layer dielectric substrate 10, isolation between the upper and lower radiation electrodes 6 and 12 can be adjusted. Moreover, by setting the permittivity of the multi-layer dielectric substrate 10 to be higher than the permittivity of the base dielectric substrate 1, a wider frequency band can be obtained.

Figure 10:
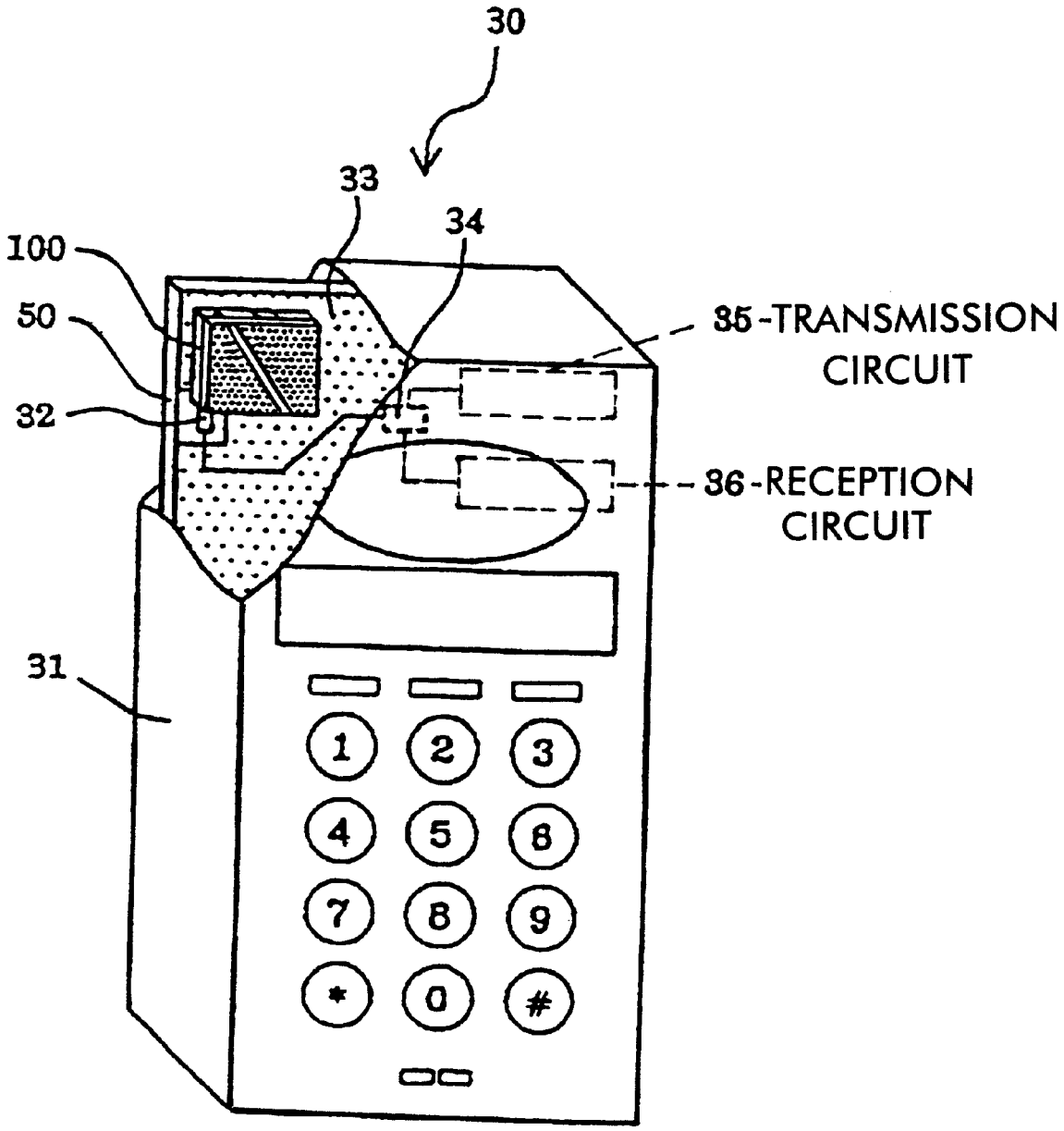
FIG. 10 is a view illustrating a communication apparatus according to an embodiment of the present invention.

FIG. 10 shows a communication apparatus according to an embodiment of the present invention. In this figure, a mounting substrate 50 is disposed inside a case 31 of a communication apparatus 30 such as a cellular phone. A feeding circuit 32 is formed on the mounting substrate 50. On a grounded surface 33 (grounding electrode) of the mounting substrate 50, a surface-mounted antenna 100 according to one of the above-described first to seventh embodiments is mounted. The surfacemounted antenna 100 is connected to the feeding circuit 32 having a signal source 4 directly or by a capacitive coupling. The feeding circuit 32 is connected to a transmission circuit 35 and a reception circuit 36 via a switching circuit 34. In this communication apparatus, a feeding signal of the signal source 4 of the feeding circuit 32 is supplied to the surface-mounted antenna 100 to perform the above-mentioned antenna operation, which is equivalent to the excitations of radiation electrodes 6 and 12. Then, by the switching operations of the switching circuit 34, signal transmission/reception can be smoothly performed.

The present invention is not limited to the above embodiments. Various modifications and changes can be applied to the invention. For example, in each of the above embodiments, although the direction in which the first radiation electrode 6 excites is set to be substantially perpendicular to the direction in which the second radiation electrode 12 excites, both directions need not be substantially perpendicular to each other. For example, while maintaining the narrow gap between the radiation electrodes 6 and 12, both directions only need to intersect with each other at an angle capable of suppressing interference between the resonant signals of the first radiation electrode 6 and second radiation electrode 12 to a degree in which no problem practically occurs.

In addition, the shapes (electrode patterns) of the first radiation electrode 6 and second radiation electrode 12 are not limited to those of the above embodiments. Other electrode shapes can be used according to performance specifications.

In addition, the communication apparatus is not limited to a cellular phone. The present invention can be applied to various communication apparatus incorporating antennas.

As described above, in each of the antenna and the communication apparatus according to the present invention, the multi-layer dielectric substrate is laminated on the upper surface of the base dielectric substrate to be integrated therewith, and the direction in which the first radiation electrode formed on the upper surface of the base dielectric substrate excites differs from the direction in which the second radiation electrode formed on the upper surface of the multi-layer dielectric substrate excites. That is, the above directions are not parallel to each other. With this arrangement, interference of the resonant signals between the lower first radiation electrode and the upper second radiation electrode can be effectively suppressed. Therefore, isolation is enhanced and the band of a used frequency can thereby be widened.

Particularly, since the first radiation electrode formed on the upper surface of the base dielectric substrate is not opposed to the second radiation electrode formed on the upper surface of the multi-layer dielectric substrate, isolation can be more enhanced to widen the frequency band. Moreover, as mentioned above, since the directions in which the lower first radiation electrode and the upper second radiation electrode excite differ from each other, even though the gap between the first radiation electrode on the base dielectric substrate and the second radiation electrode on the multi-layer dielectric substrate in the parallel direction is narrowed, sufficient isolation can be obtained. Therefore, since the gap can be narrowed, the sizes of the antenna and the communication apparatus incorporating the same can be reduced.

In addition, the first and second radiation electrodes as the first-layer radiation electrodes are formed via the gap on the upper surface of the base dielectric substrate, and other first and second radiation electrodes as the second-layer radiation electrodes are formed via the gap on the upper surface of the multi-layer dielectric substrate integrated by being laminated on the upper surface of the base dielectric substrate. In the antenna and the communication apparatus having this arrangement according to the present invention, since the directions in which the first and second radiation electrodes of each layer excite differ from each other, even though the gap between the first and second radiation electrodes formed on each layer is narrowed, the isolation of signals between the first and second radiation electrodes can be enhanced. Since the gap can be narrowed, the antenna and the communication apparatus can be miniaturized. Moreover, by narrowing the gap, there is another advantage in that the areas occupied by the radiation electrodes can be increased.

Furthermore, since the directions in which the lower radiation electrode and the upper radiation electrode vertically adjacent excite differ from each other, that is, since the directions are set to be non-parallel to each other, high isolation between the upper and lower radiation electrodes can be obtained. In this way, since both isolations between the radiation electrodes of the same layer and isolation between the vertically adjacent radiation electrodes can be obtained, a double resonance by the first and second radiation electrodes on each layer can be normally performed while suppressing signal interference therebetween. With this arrangement, sufficiently satisfactory widening of the frequency band can be achieved.

In addition, since the edges of the first and second radiation electrodes opposing via the gap are oblique lines, the directions in which the first and second radiation electrodes excite can be set to be different. Moreover, by varying the length and angle of the gap, there is another advantage in that the exciting directions can be easily and freely adjusted.

In addition, since the multi-layer dielectric substrate is laminated on the base dielectric substrate, by selectively changing the permittivity of the multi-layer dielectric substrate, the isolation between the radiation electrode formed on the base dielectric substrate and the radiation electrode formed on the multi-layer dielectric substrate can be easily adjusted. Similarly, when a plurality of the multi-layer dielectric substrates are laminated on the upper surface of the base dielectric substrate to be integrated therewith, by selectively changing the permittivity of the multi-layer dielectric substrate of a specified layer, the isolation between the upper and lower radiation electrodes of the specified multi-layer dielectric substrate can be easily adjusted.

In addition, by setting the permittivity of the multi-layer dielectric substrate to be higher than the permittivity of the base dielectric substrate, electric fields can be concentrated on the multi-layer dielectric substrate without concentrating on the capacitance of the mounting substrate. As a result, since narrowing of the frequency band caused by concentration of the electric fields on the capacitance of the mounting substrate can be prevented, widening of the band of a set frequency as a used frequency can be achieved.

In addition, in the antenna and the communication apparatus according to the present invention, as mentioned above, since the frequency band for communications can be widened by enhancing the isolation between the radiation electrodes, communication reliability can also be improved.

Although the present invention has been described in relation to particular embodiments thereof many other variations and modifications and other uses will become apparent to those skilled in the art. It is preferred, therefore, that the present invention be limited not by the specific disclosure herein, but only by the appended claims.

What is claimed is:

1. A surface-mounted antenna comprising:

a base dielectric substrate;

a first radiation electrode formed on a part of a first surface of the base dielectric substrate;

a multi-layer dielectric substrate laminated on the first surface of the base dielectric substrate to be integrated therewith, the multi-layer dielectric substrate having a first surface spaced from the first surface of the base dielectric substrate; and a second radiation electrode formed on the first surface of the multi-layer dielectric substrate in a position where the second radiation electrode is not opposed to the first radiation electrode;

wherein directions in which the first radiation electrode and the second radiation electrode excite intersect with each other.

2. The surface-mounted antenna of claim 1, wherein the directions are approximately perpendicular.

3. The surface-mounted antenna of claim 1, wherein the first surfaces of both the base dielectric substrate and the multi-layer dielectric substrate have four-sided shapes; the first radiation electrode being formed on substantially half of a first region of the first surface of the base dielectric substrate; the second radiation electrode being formed on substantially half of a second region of the first surface of the multi-layer dielectric substrate, said second region being opposite to a side where the first radiation electrode is formed; and edges of the first and second radiation electrodes present on sides mutually opposing via the multi-layer dielectric substrate forming oblique lines.

4. The surface-mounted antenna of claim 3, wherein gain and bandwidth of the surface-mounted antenna can be adjusted by changing at least one of a gap between said oblique lines, an angle formed by said gap with respect to an edge of said surface-mount antenna and an electrical permittivity of said multi-layer dielectric substrate.

5. The surface-mounted antenna of claim 1, further comprising a feeding connection electrode coupled to each of said first and second radiation electrodes.

6. The surface-mounted antenna of claim 5, wherein the feeding connection electrode is capacitively coupled to said first and second radiation electrodes.

7. The surface-mounted antenna of claim 5, wherein the feeding connection electrode is conductively coupled to said first and second radiation electrodes.

8. The surface-mounted antenna of claim 1, wherein the permittivity of the multi-layer dielectric substrate is set to be higher than the permittivity of the base dielectric substrate.

9. A surface-mounted antenna comprising:

a base dielectric substrate;

a first radiation electrode and a second radiation electrode formed on a first surface of the base dielectric substrate with a gap therebetween;

at least one multi-layer dielectric substrate laminated on the first surface of the base dielectric substrate to be integrated therewith, the multi-layer dielectric substrate having a first surface spaced from the first surface of the base dielectric substrate; and another first radiation electrode and another second radiation electrode formed on the first surface of the multi-layer dielectric substrate with a gap therebetween;

wherein directions in which the first radiation electrode and the second radiation electrode formed on each of the base dielectric substrate and the at least one multi-layer dielectric substrate excite intersect with each other, and directions in which vertically adjacent first and second radiation electrodes of the respective first surfaces excite differ from each other.

10. The surface-mounted antenna of claim 9, wherein the directions in which the first radiation electrode and the second radiation electrode formed on each of the base dielectric substrate and the at least one multi-layer dielectric substrate excite and intersect are approximately perpendicular.

11. The surface-mounted antenna of claim 9, wherein the first surfaces of both the base dielectric substrate and the multi-layer dielectric substrate have four-sided shapes, and edges opposing via the gaps between the first radiation electrodes and the second radiation electrodes of the respective first surfaces form oblique lines.

12. The surface-mounted antenna of claim 11, wherein gain and bandwidth of the surface-mounted antenna can be adjusted by changing at least one of a gap between said oblique lines, an angle formed by said gap with respect to an edge of said surface-mount antenna and an electrical permittivity of said multi-layer dielectric substrate.

13. The surface-mounted antenna of claim 9, further comprising a feeding connection electrode coupled to each of said first and second radiation electrodes.

14. The surface-mounted antenna of claim 13, wherein the feeding connection electrode is capacitively coupled to said first and second radiation electrodes.

15. The surface-mounted antenna of claim 11 wherein the feeding connection electrode is conductively coupled to said first and second radiation electrodes.

16. The surface-mounted antenna of claim 9, further comprising a plurality of multi-layer dielectric substrates stacked one on top of each other, each having first and second radiation electrodes formed on a first surface thereof.

17. The surface-mounted antenna of claim 16, wherein the permittivity of the multi-layer dielectric substrate furthest from the base dielectric substrate is set to be higher than the permittivity of any other multi-layer dielectric substrate.

18. The surface-mounted antenna of claim 9, wherein the permittivity of the multi-layer dielectric substrate is set to be higher than the permittivity of the base dielectric substrate.

19. A surface-mounted antenna comprising:

a base dielectric substrate;

a first radiation electrode formed on a first surface of the base dielectric substrate;

a multi-layer dielectric substrate laminated on the base dielectric substrate to be integrated therewith, the multi-layer dielectric substrate having a first surface spaced from the first surface of the base dielectric substrate; and a second radiation electrode formed on the first surface of the multi-layer dielectric substrate;

wherein directions in which the first and second radiation electrodes excite intersect with each other.

20. The surface-mounted antenna of claim 19, wherein the directions are approximately perpendicular.

21. The surface-mounted antenna of claim 19, wherein the first and second radiation electrodes each have a curved edge, with the two electrodes being disposed in an orientation so that one is flipped with respect to the other, whereby a curved edge of one electrode curves in a first direction and the curved edge of the other electrode curves in a direction opposite the first direction.

22. The surface-mounted antenna of claim 21, wherein the feeding electrode couples to the first and second electrodes via connecting paths that are disposed at approximately 90° to each other.

23. The surface-mounted antenna of claim 21, wherein the feeding electrode is conductively coupled to the first and second radiation electrodes.

24. A communication apparatus comprising:

at least one of a transmitter and a receiver;

a surface-mounted antenna coupled to the at least one of a transmitter and a receiver;

the surface mounted antenna comprising:

a base dielectric substrate;

a first radiation electrode formed on a part of a first surface of the base dielectric substrate;

a multi-layer dielectric substrate laminated on the first surface of the base dielectric substrate to be integrated therewith, the multi-layer dielectric substrate having a first surface spaced from the first surface of the base dielectric substrate; and a second radiation electrode formed on the first surface of the multi-layer dielectric substrate in a position where the second radiation electrode is not opposed to the first radiation electrode;

wherein directions in which the first radiation electrode and the second radiation electrode excite intersect with each other.

25. The communication apparatus of claim 24, wherein the directions are approximately perpendicular.

26. The communication apparatus of claim 24, wherein the first surfaces of both the base dielectric substrate and the multi-layer dielectric substrate have four-sided shapes; the first radiation electrode being formed on substantially half of a first region of the first surface of the base dielectric substrate; the second radiation electrode being formed on substantially half of a second region of the first surface of the multi-layer dielectric substrate, said second regions being opposite to a side where the first radiation electrode is formed; and edges of the first and second radiation electrodes present on sides mutually opposing via the multi-layer dielectric substrate forming oblique lines.

27. The communication apparatus of claim 26, wherein gain and bandwidth of the surface-mounted antenna can be adjusted by changing at least one of a gap between said oblique lines, an angle formed by said gap with respect to an edge of said surface-mount antenna and an electrical permittivity of said multi-layer dielectric substrate.

28. The communication apparatus of claim 24, further comprising a feeding connection electrode coupled to each of said first and second radiation electrodes.

29. The communication apparatus of claim 28, wherein the feeding connection electrode is capacitively coupled to said first and second radiation electrodes.

30. The communication apparatus of claim 28, wherein the feeding connection electrode is conductively coupled to said first and second radiation electrodes.

31. The communication apparatus of claim 24, wherein the permittivity of the multi-layer dielectric substrate is set to be higher than the permittivity of the base dielectric substrate.

32. A communication apparatus comprising:

at least one of a transmitter and a receiver;

a surface-mounted antenna coupled to the at least one of a transmitter and a receiver, the surface mounted antenna comprising:

a base dielectric substrate;

a first radiation electrode and a second radiation electrode formed on a first surface of the base dielectric substrate with a gap therebetween;

at least one multi-layer dielectric substrate laminated on the first surface of the base dielectric substrate to be integrated therewith, the multi-layer dielectric substrate having a first surface spaced from the first surface of the base dielectric substrate; and another first radiation electrode and another second radiation electrode formed on the first surface of the multi-layer dielectric substrate with a gap therebetween;

wherein directions in which the first radiation electrode and the second radiation electrode formed on each of the base dielectric substrate and the at least one multi-layer dielectric substrate excite intersect with each other, and directions in which vertically adjacent first and second radiation electrodes of the respective first surfaces excite differ from each other.

33. The communication apparatus of claim 32, wherein the directions in which the first radiation electrode and the second radiation electrode formed on each of the base dielectric substrate and the at least one multi-layer dielectric substrate excite and intersect are approximately perpendicular.

34. The communication apparatus of claim 32, wherein the first surfaces of both the base dielectric substrate and the multi-layer dielectric substrate have four sided shapes, and edges opposing via the gaps between the first radiation electrodes and the second radiation electrodes of the respective first surfaces form oblique lines.

35. The communication apparatus of claim 34, wherein gain and bandwidth of the surface-mounted antenna can be adjusted by changing at least one of a gap between said oblique lines, an angle formed by said gap with respect to an edge of said surface-mount antenna and an electrical permittivity of said multi-layer dielectric substrate.

36. The communication apparatus of claim 32, further comprising a feeding connection electrode coupled to each of said first and second radiation electrodes.

37. The communication apparatus of claim 36, wherein the feeding connection electrode is capacitively coupled to said first and second radiation electrodes.

38. The communication apparatus of claim 36 wherein the feeding connection electrode is conductively coupled to said first and second radiation electrodes.

39. The communication apparatus of claim 32, further comprising a plurality of multi-layer dielectric substrates stacked one on top of each other, each having first and second radiation electrodes formed on a first layer thereof.

40. The surface-mounted antenna of claim 39, wherein the permittivity of the multi-layer dielectric substrate farthest from the base dielectric substrate is set to be higher than the permittivity of any other multi-layer dielectric substrate.

41. The communication apparatus of claim 32, wherein the permittivity of the multi-layer dielectric substrate is set to be higher than the permittivity of the base dielectric substrate.

42. A communication apparatus comprising:

at least one of a transmitter and a receiver;

a surface-mounted antenna coupled to the at least one of a transmitter and a receiver, the surface-mounted antenna comprising:

a base dielectric substrate;

a first radiation electrode formed on a first surface of the base dielectric substrate;

a multi-layer dielectric substrate laminated on the base dielectric substrate to be integrated therewith, the multi-layer dielectric substrate having a first surface spaced from the first surface of the base dielectric substrate; and a second radiation electrode formed on the first surface of the multi-layer dielectric substrate;

wherein directions in which the first and second radiation electrodes excite intersect with each other.

43. The communication apparatus of claim 42, wherein the directions are approximately perpendicular.

44. The communication apparatus of claim 42, wherein the first and second radiation electrodes each have a curved edge, with the two electrodes being disposed in an orientation so that one is flipped with respect to the others whereby a curved edge of one electrode curves in a first direction and the curved edge of the other electrode curves in a direction opposite the first direction.

45. The communication apparatus of claim 44, wherein the feeding electrode couples to the first and second electrodes via connecting paths that are disposed at approximately 90° to each other.

46. The communication apparatus of claim 44, wherein the feeding electrode is conductively coupled to the first and second radiation electrodes.

* * * * *